US008950495B2

(12) United States Patent
Barbour et al.

(10) Patent No.: US 8,950,495 B2
(45) Date of Patent: Feb. 10, 2015

(54) WELL CLEANING METHOD

(75) Inventors: Joel Scott Barbour, Henderson, NV (US); Dennis Andrew Chapman, Henderson, NV (US); Paul Edward Weatherford, Henderson, NV (US); David Andrew McCartney, Las Vegas, NV (US)

(73) Assignee: Past, Inc., Henderson, NV (US)

( * ) Notice: Subject to any disclaimer, the term of this patent is extended or adjusted under 35 U.S.C. 154(b) by 210 days.

(21) Appl. No.: 13/604,562

(22) Filed: Sep. 5, 2012

(65) Prior Publication Data

US 2014/0060844 A1 Mar. 6, 2014

(51) Int. Cl.
*E21B 37/00* (2006.01)

(52) U.S. Cl.
USPC ..... 166/311; 166/177.1

(58) Field of Classification Search
CPC ..... E21B 28/00; E21B 37/00; E21B 37/08
USPC ..... 166/311, 65.1, 177.1
See application file for complete search history.

(56) References Cited

U.S. PATENT DOCUMENTS

| | | | | |
|---|---|---|---|---|
| 3,180,418 | A * | 4/1965 | MacLeod | 166/311 |
| 4,040,000 | A | 8/1977 | Dwivedi | |
| 4,343,356 | A * | 8/1982 | Riggs et al. | 166/60 |
| 4,345,650 | A | 8/1982 | Wesley | |
| 4,651,311 | A | 3/1987 | Owen et al. | |
| 4,734,894 | A | 3/1988 | Cannelli et al. | |
| 5,208,788 | A | 5/1993 | Dancer et al. | |
| 5,228,011 | A | 7/1993 | Owen | |
| 5,301,169 | A | 4/1994 | Baria et al. | |
| 5,841,737 | A | 11/1998 | Schaefer | |
| 6,227,293 | B1 | 5/2001 | Huffman et al. | |
| 6,687,189 | B1 | 2/2004 | Schaefer et al. | |

FOREIGN PATENT DOCUMENTS

| | | | |
|---|---|---|---|
| RU | 2373386 | C1 | 11/2009 |
| RU | 2373387 | C1 | 11/2009 |
| RU | 2385472 | C2 | 3/2010 |
| WO | WO2004061257 | | 7/2004 |

* cited by examiner

*Primary Examiner* — William P Neuder
(74) *Attorney, Agent, or Firm* — SoCal IP Law Group LLP; John E. Gunther; Mark A. Goldstein

(57) ABSTRACT

A method for cleaning a casing of an oil well is disclosed. Operational parameters for a cleaning tool may be defined based, at least in part, on results of a survey of the well. The cleaning tool may include a discharge head to generate electrical discharges between a pair of electrodes, the electrical discharges causing shock waves to remove deposits from the casing. The cleaning tool may be lowered into the casing. The cleaning tool may generate shock waves in accordance with the defined operational parameters to clean a predetermined target portion of the casing. The cleaning tool may be withdrawn from the casing.

16 Claims, 4 Drawing Sheets

© 2012 Barbour Well

© 2012 Barbour Well

© 2012 Barbour Well

© 2012 Barbour Well

© 2012 Barbour Well

WELL CLEANING METHOD

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

RELATED APPLICATION INFORMATION

This application is related to patent application Ser. No. 13/605,450, entitled WELL CLEANING TOOL, filed on Sep. 6, 2012.

BACKGROUND

1. Field

This disclosure relates to a method of cleaning well bores, and in particular cleaning casings of oil wells, geothermal energy wells, and other wells.

2. Description of the Related Art

Petroleum products such as oil and natural gas are commonly produced by drilling a borehole or wellbore into the earth through the oil or gas producing subsurface formation. In some cases, the petroleum product may be extracted directly through the drilled borehole. More commonly, a pipe casing is placed in the borehole, for example to prevent collapse of the borehole or to prevent contamination of other subsurface formations. In the oil production industry, a distinction is commonly made between a "casing" (a pipe string that extends to the top of the borehole) and a "liner" (a pipe string, hung within a larger casing, that does not extend to the top of the borehole). This distinction is not relevant in this patent, and the term "casing" as used herein refers to any pipe string within a borehole. The annular space between the outside of the casing and the borehole may be filled, in whole or in part, with cement to retain the casing in position and to prevent fluids from traveling between subsurface layers via the annular space. An appropriate portion of the casing may be perforated to allow the petroleum product to flow from the producing formation into the casing. In some wells, the annular space between the outside of the perforated portion of the casing and the borehole may be filled with gravel. In this patent, the combination of the borehole, the casing, the cement, the gravel if present, and any associated surface equipment will be referred to generally as a "well". Similar wells may be used to extract superheated water for geothermal power generation or to inject water or other fluids into a subsurface formation to simulate oil or gas production.

After a period of production of fluids from a well or injection of fluids into a well, the perforations or openings in the casing may become plugged or encrusted, restricting the flow of fluids into or out of the casing. Materials that may be deposited in the casing include paraffin, asphalt, other petroleum products, mineral scale, and biological organisms. Unchecked, such deposits may reduce the flow of fluids until the well is not useful for its intended purpose, necessitating re-perforating or replacing portions of the casing.

A number of approaches have been suggested for cleaning flow-restricting deposits from wells. These approaches include treatment with acids or other chemicals, ultrasonic vibrations, or mechanical shock waves resulting from, for example, detonation of gases or explosives within the well bore. Such well cleaning techniques have limited effect and/or risk erosion of or other damage to the well casing.

Another proposed technique for cleaning wells is to use repetitive electrical discharges to produce mechanical shock waves. Electric discharge devices, commonly called "sparkers", have been used to generate acoustic waves for subsea surface mapping. Such devices create a shock wave by discharging stored energy between a pair of electrodes immersed in the body of water being mapped.

U.S. Pat. No. 4,343,356 describes a high energy electric discharge device designed to be lowered into a well casing. The device is discharged at intervals as it is lowered into the well casing to create shock waves to clean the adjacent portions of the casing. Each electrical discharge may also generate ultraviolet light and/or ozone, which may also contribute to cleaning the adjacent portions of the casing of organic or biological materials.

U.S. Pat. No. 4,343,356 teaches that the electric discharge device may be used in any natural fluid within the well casing, including water, brine, oil, solvents, acids, or other chemicals adapted to attack plugging materials. In order to avoid random timing of and an unpredictable path for the discharges, this patent describes initiating the electric discharge with a fine wire bridging the electrodes. Since the wire is vaporized by each discharge, this approach requires a mechanism for replacing the fine wire before each subsequent discharge. Providing a mechanism to feed wire between the electrodes substantially complicates the design of and may reduce the reliability of a well cleaning tool.

Further, experiments conducted by the inventors of the well cleaning method, system and tool described herein have shown that discharging a cleaning tool in an environment that is predominantly oil results in prolonged limited-current discharges that do not produce substantial shock waves and is ineffective for well cleaning. Further, discharging a cleaning tool when oil is present in the discharge head of the tool results in rapid deterioration of insulating surfaces of the tool exposed to the discharges. This deterioration commonly takes the form of erosion or cracking along the insulating surfaces. The cause of the deterioration may be deposition of carbon on the insulating surfaces, which provides a path for the stored energy to discharge across the insulating surface.

Throughout this description, elements appearing in figures are assigned three-digit reference designators, where the most significant digit is the figure number where the element is first introduced, and the two least significant digits are specific to the element. An element that is not described in conjunction with a figure may be presumed to have the same characteristics and function as a previously-described element having the same reference designator.

DETAILED DESCRIPTION

Description of Apparatus

Figure 1:
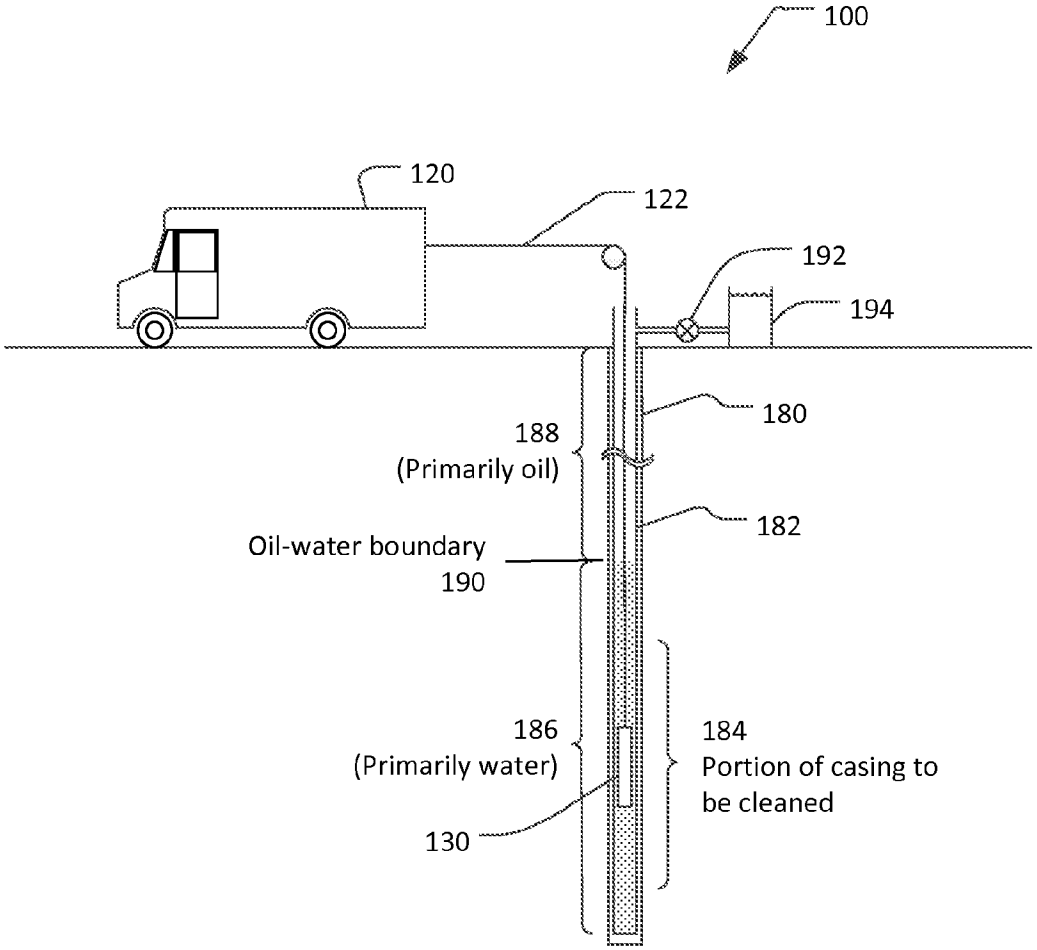
FIG. 1 is a schematic diagram of a well bore cleaning system in an environment.

Referring now to FIG. 1, a well cleaning system 100 may include a surface installation 120 (illustrated in FIG. 1 as a truck), a cable 122, and a cleaning tool 130. The surface installation 120 may use the cable 122 to lower the cleaning tool 130 into a borehole 180 which is typically lined with a casing 182. All or portions of the annular space between the borehole 180 and the casing 182 may be filled with cement and/or gravel (not shown in FIG. 1). The cleaning tool 130 may be configured to create an electrical discharge between a pair of electrodes. The electrical discharge may, in turn, generate a shock wave in the fluid within the casing 182 to clean a portion of the casing proximate to the discharge location. The electrical discharge may also produce ozone and/or ultraviolet light which may provide an additive cleaning effect. The cleaning tool 130 may create electrical discharges at intervals as the tool is lowered into and/or withdrawn from the casing 182.

A well may extract fluids from, or inject fluids into, a subsurface layer or formation, commonly called a "production zone". A thickness of a production zone may range from less than 25 feet to 600 feet or more. A production zone may be located at a depth of several hundred feet to several miles below the surface. Many wells extract fluids from, or inject fluids into, a single production zone. In this case, only a portion of the casing 182 passing through the production zone may have perforations or other openings to allow fluids to be exchanged between the casing 182 and the surrounding subsurface formation. Since these perforations may be most susceptible to clogging and/or plugging, the cleaning tool 130 may be used to clean only a target portion 184 of the casing having perforations. Other wells may extract fluids from two or more production zones. Such wells may have a corresponding number of target portions 184 requiring cleaning.

As previously discussed, discharging the cleaning tool 130 in an environment that is predominantly oil is ineffective for cleaning and causes rapid deterioration of the tool. For this reason, the one or more target portion 184 of the casing may be filled with water, or mostly water, during cleaning. Many wells produce oil mixed with water. In such wells, stopping the flow of fluids from the well may cause gravity separation of the water and oil such that a lower portion 186 of the well becomes filled primarily with the heavier water and an upper portion 188 of the well becomes filled primarily with the lighter oil. The primarily water-filled lower portion 186 and the primarily oil-filled upper portion 188 may meet at an oil-water boundary 190. The oil-water boundary 190 may be a transition zone containing emulsified oil and water rather than a sharp demarcation.

In order to prevent deterioration of the cleaning tool 130, the oil-water boundary 190 should be above the one or more target portion 184 of the casing to be cleaned. If the amount of naturally occurring water in the well is not sufficient to cause the oil-water boundary 190 to be above the one or more target portion 184 to be cleaned, a pump 192 may be used to add additional water to the casing from a reservoir 194 or other source. Oil wells commonly have the capability of pumping water or other fluids into the casing. Water may be added to the well until the oil-water boundary 190 is above all of the one or more target portion 184 to be cleaned.

Figure 2:
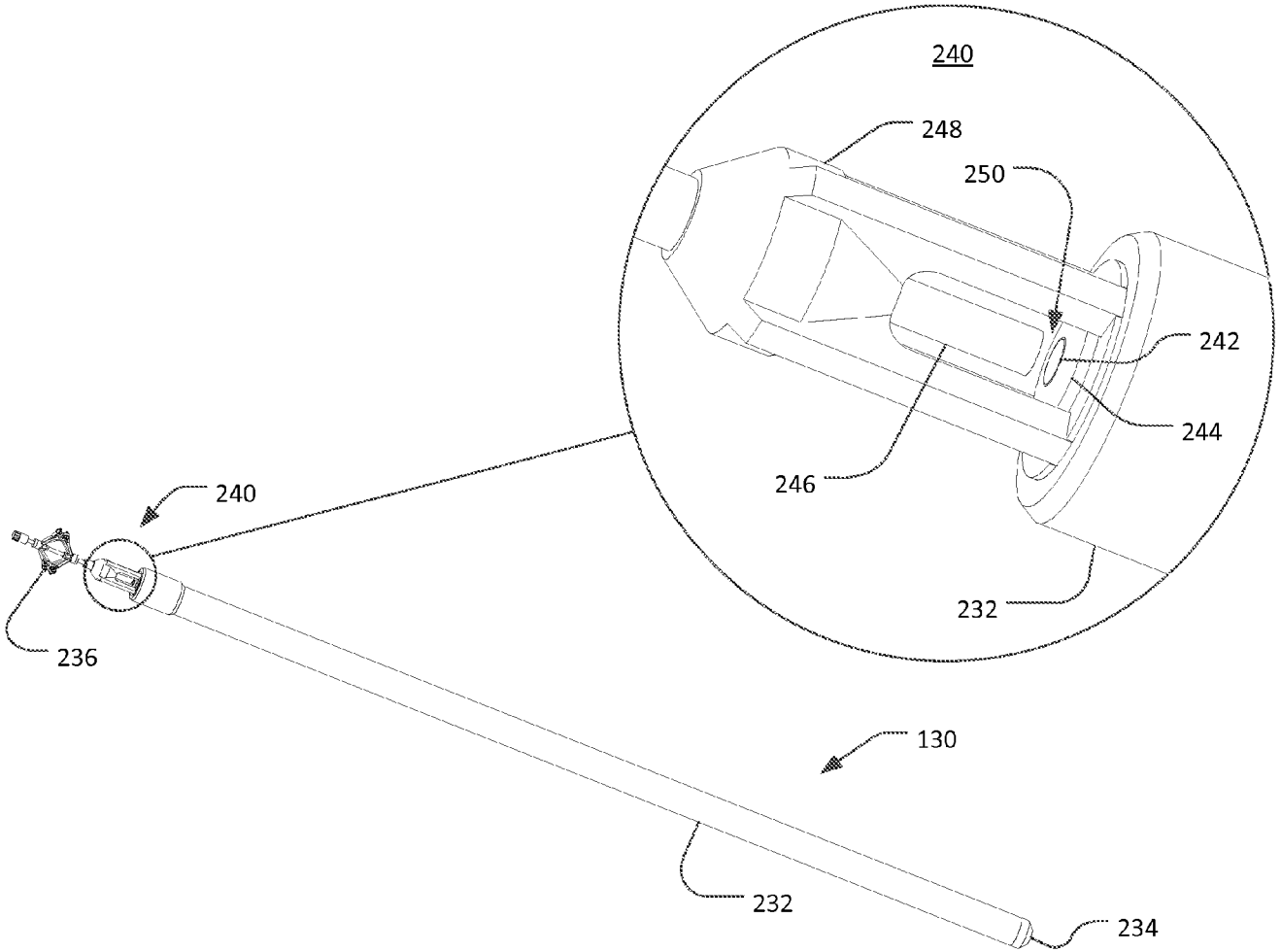
FIG. 2 is a perspective view of a well bore cleaning tool.

Referring now to FIG. 2, the cleaning tool 130 may have an elongate cylindrical body 232 configured to be lowered into a well casing. A first end 234 of the body may be adapted to connect to a cable that provides electrical power to the cleaning tool 130 and provides a mechanism to lower the cleaning tool 130 into, and extract the cleaning tool 130 from, the casing. A discharge head 240 may be located at the opposite end of the body 232. A conventional centralizer 236 may be attached adjacent the discharge head 240 to ensure that the discharge head is centrally located within the casing.

A shown in the detail view, the discharge head 240 may have a positive electrode 242 and a negative electrode 246 separated by a gap 250. When a high voltage is placed between the positive electrode 242 and the negative electrode 246, an electrical discharge may occur across the gap 250. The electrical discharge may produce a substantial shock wave in the fluid present in the gap (i.e. the fluid present in the well being cleaned). The shock wave may propagate symmetrically and outwardly from the gap to impact the interior wall of the casing. The effect of the impact of the shock wave and the casing cleans undesired deposits from an annular band of the casing.

The negative electrode 246 may be held by a holder 248 having three or four legs coupled to the body 232. The holder 248 may hold the negative electrode 246 in position to set a desired width of the gap 250 between the positive and negative electrodes. The holder 248 may also provide an electrical connection between the body 232 and the negative electrode 246.

The positive electrode 242 may be separated from the holder 248 by an insulator 244. Insulator 244 provides electrical isolation for the positive electrode 242 and inhibits electrical discharge directly between the positive electrode 242 and the legs of the holder 248. The integrity of the exposed surface of the insulator 244 is important to the operation of the cleaning tool. Discharging the tool in the presence of oil or when the surface of insulator 244 is contaminated with oil may result in deposition of carbon particles or a carbon film on the insulator surface. Since carbon is electrically conductive, carbon deposits on the insulator surface may cause electrical discharges to occur across the insulator surface rather than between the electrodes 242 and 246 across the gap 250. Electrical discharges across the insulator surface may create conductive carbonized tracks on the previously insulating surface, which will encourage further discharges to follow the same path. Shock waves produced by electrical discharges across the insulator surface will not be as high in amplitude or as symmetrical as shock waves produced by discharges between the electrodes 242, 246.

Figure 3:
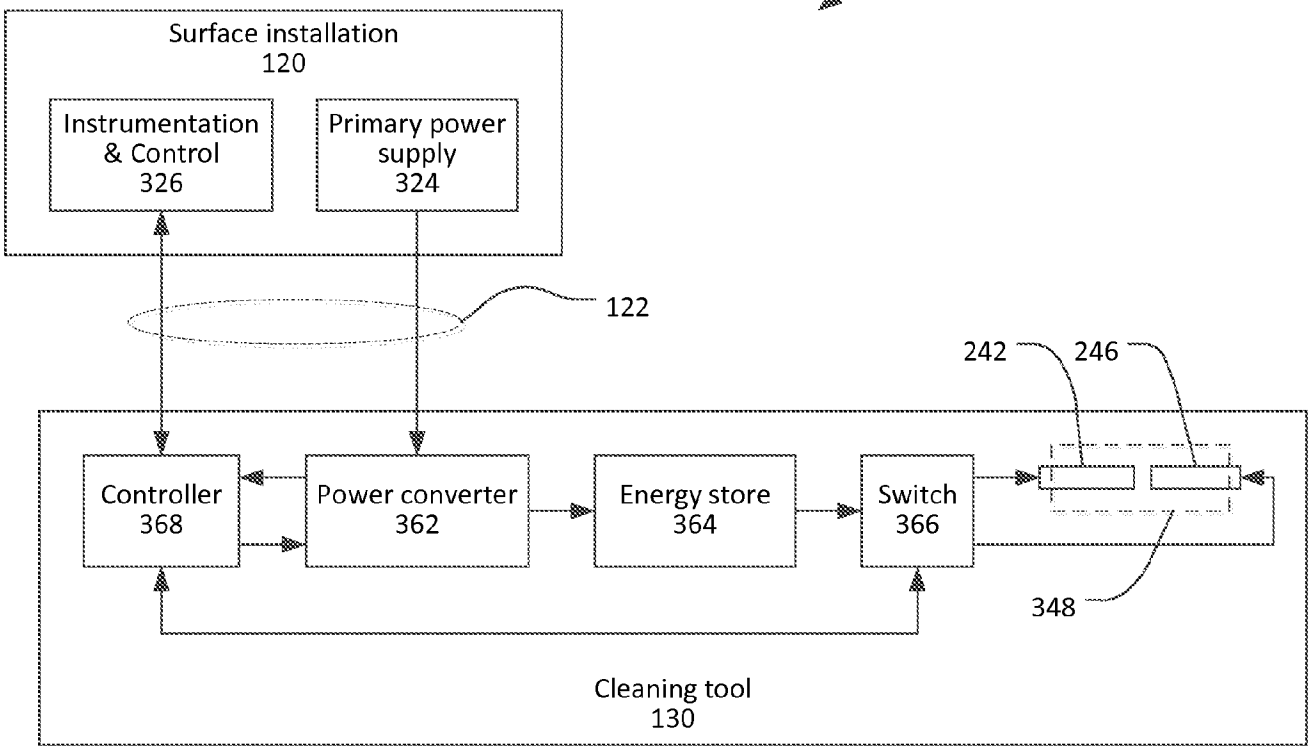
FIG. 3 is a block diagram of the well bore cleaning system

FIG. 3 shows a block diagram of the well cleaning system 100, which includes a surface installation 120 and a cleaning tool 130 linked by a cable 122. The cable 122 may include a wire rope or other structural member for raising and lowering the cleaning tool 130 in the well. The cable 122 may also include at least a pair of electrical conductors for conveying electrical power from the surface installation 120 to the cleaning tool 130. The cable may include one or more electrical wires or optical fibers for conveying data and control information between the surface installation 120 and the cleaning tool 130.

The surface installation 120 may commonly be housed in a truck, as illustrated in FIG. 1, but is not limited to that implementation. The surface installation may include a primary power supply 324, which may be, for example, a generator or batteries. The primary power supply 324 may provide primary power to the cleaning tool 130 via the cable 122. The primary power may be AC or DC power. The primary power voltage may be several hundred volts or greater to minimize the effects of a voltage drop that will occur in the cable 122, which may extend as far as several miles into the well.

The surface installation 120 may also include instrumentation and control subsystem 326 to control and document the operation of the cleaning tool. At a minimum, the instrumentation and control subsystem 326 may provide the ability to selectively enable operation of the cleaning tool 130 when the tool is in a target region of the casing requiring cleaning and to selectively disable operation of the tool in other regions. This may be achieved via commands sent over cable 122. The instrumentation and control subsystem 326 may be configured to control operational parameters of the well cleaning system 100 via cable 122. For example, the instrumentation and control subsystem 326 may be configured to control one or more of the rate at which the tool descends and ascends in the casing, the rate or frequency of electrical discharges produced by the tool, the electrical voltage or energy of each discharge, and other operational parameters.

The instrumentation and control subsystem 326 may also document the operation of the well cleaning system. For example, the instrumentation and control subsystem 326 may store or otherwise document the depth and time when the cleaning tool was activated and the depth and time when the cleaning tool 130 was deactivated. If appropriate feedback is received from the cleaning tool 130 over cable 122, the instrumentation and control subsystem may store additional data such as, for example, a count of the number of electric discharges that occurred between activation and deactivation, the time and depth of some or all of the electrical discharges, the time duration and/or peak current of some or all of the electrical discharges, and other information.

Control and feedback information may flow between the instrumentation and control subsystem 326 and the cleaning tool 130 via the cable 122. The control and feedback information may flow via separate wires or optical fibers in the cable 122. Alternatively or additionally, control and feedback information may flow over the same wires used to convey the primary power. Information may be conveyed over the primary power wires using any of numerous techniques and standards developed for power line communications for applications such as utility grid monitoring and home networking.

The cleaning tool 130 may include a power converter 362. The power converter 362 may receive primary power from the primary power supply via the cable 122 and may convert the primary power into DC power of sufficiently high voltage to create a discharge between electrodes 242 and 246. A variety of techniques and circuits may be used in the power converter. For example, the power converter may include a DC-AC inverter to convert DC primary power into a high frequency AC signal, a step-up transformer that accepts the AC signal and outputs a higher voltage AC signal, and a voltage multiplier that uses a combination of rectifiers and capacitors to convert the output of the step-up transformer into a high DC voltage level. For example, 200-volt DC primary power may be converted into a 200-volt high frequency AC signal. In this example, the 200-volt AC signal may be applied to a primary winding of a step-up transformer having a 1:15 turns ratio between its primary and secondary windings. The step-up transformer secondary winding may output a 3000-volt AC signal. The 3000-volt AC signal may be tripled in a voltage multiplier to provide a 9000 volt DC level.

The cleaning tool 130 may include an energy store 364 fed by the output of the power converter 362. The energy store 364 may be, for example, a high voltage capacitor or a plurality of capacitors connected in series and/or parallel to collectively function as a high voltage capacitor. The power converter 362 may be configured with a limited output current capacity, such that the energy store 364 may be gradually charged from a discharged state to the full voltage output from the power converter. Once the energy store 364 is charged to a desired voltage level, a switch 366 may connect the energy store to the electrodes 242 and 246, causing an electrical discharge that depletes the energy stored in the energy store 364. The power converter 362 may then begin recharging the energy store 364 in preparation for the next electrical discharge.

The switch 366 may be, for example, a triggered spark gap. The switch 366 may be a solid state switch using a cascade of semiconductor devices as described, for example, in U.S. Pat. No. 4,040,000. The switch 366 may be a gas-filled or vacuum tube device such as a thyratron or krytron. The switch 366 may be another device or combination of devices capable of both blocking the high voltage level produced by the power converter and passing very high instantaneous current each time the stored energy is discharged through the electrodes 242, 246.

The cleaning tool 130 may include a controller 368. The controller may be configured to control the operation of the cleaning tool and to periodically trigger the switch 366 to initiate a series of electrical discharges between the electrodes 242, 246. For example, the controller 368 may monitor voltage at the energy store 364 during charging and trigger the switch 366 when the voltage at the energy store 364 reaches a predetermined discharge level. The discharge level may be preprogrammed into the controller on the surface before the cleaning tool 130 is lowered into a well. The discharge level may be determined by the instrumentation and control subsystem 326 and communicated to the controller 368 in the well via the cable 122.

The controller 368 may be configured to selectively enable and disable the operation of the cleaning tool 130 in response to commands received from the instrumentation and control subsystem via the cable 122. Alternatively, the operation of the cleaning tool 130 may be enabled and disabled from the surface by selectively providing or not providing the primary power from the primary power supply 324.

The controller 368 may be configured to transmit feedback information to the instrumentation and control subsystem 326 via the cable 122. The controller 368 may monitor analog operational parameters of the cleaning tool 130, digitize the analog data, and transmit the digitized data via the cable using a power line communication technique. For example, the controller 368 may monitor the voltage at the energy store 364 and transmit data representative of the peak voltage prior to some or all discharges. The controller 368 may detect a voltage drop across a very low value resistor in series with one of the electrodes 242, 246 and transmit data representative of the peak current or current-versus-time waveform for some or all discharges. The controller 368 may be coupled to a sensor that detects the light generated by each discharge and transmit data representative of the peak light output or light output-versus-time waveform for some or all discharges. The controller 368 may be coupled to one or more sensors that detect the temperature at various locations or components within the cleaning tool and transmit data representative of these temperatures. The controller 368 may transmit other operational data to the instrumentation and control subsystem.

As previously discussed, discharging the cleaning tool in an oil environment can lead to deterioration of the insulating surfaces that electrically isolate the electrodes 242 and 246. To avoid this deterioration, the cleaning tool 130 may incorporate a seal 348 to prevent fouling the electrodes and adjacent insulating surfaces with oil as the tool is lowered through the primarily oil-filled upper portion 188 that may be present at the top of a well. The seal 348 may be a retractable cover configured to seal the discharge head 240 or at least the surface of insulator 244 from the oil. The cover may be retracted to allow operation of the cleaning tool 130 in the water-filled lower portion 186 of the well. The cover may be retracted, for example using a motor, a solenoid, a spring, or some other mechanism.

The seal 348 may be a consumable cover that is sealed over the discharge head 240 or at least the surface of insulator 244.

For example, the seal 348 may be a preformed cover that is sealed over all or portions of the discharge head 240 using adhesive tape before the tool is lowered into a well. The consumable cover may be filled with water or another fluid to provide a medium about the electrodes 242, 246. The consumable cover may then be destroyed or otherwise dislodged from the tool by one or more shock waves resulting from discharging the cleaning tool 130 after the cleaning tool reaches the water-filled lower portion 186 of the well.

The seal 348 may be a consumable material coated over portions of the discharge head including at least the surface of insulator 244 before the tool is lowered into a well. The coating material may be impervious to oil and soluble in water, such that the coating dissolves when the cleaning tool reaches the water-filled lower portion 186 of the well. The coating material may be, for example, a liquid soap or liquid detergent, which may also serve to emulsify any residual oil on the discharge head 240.

Description of Processes

Figure 4:
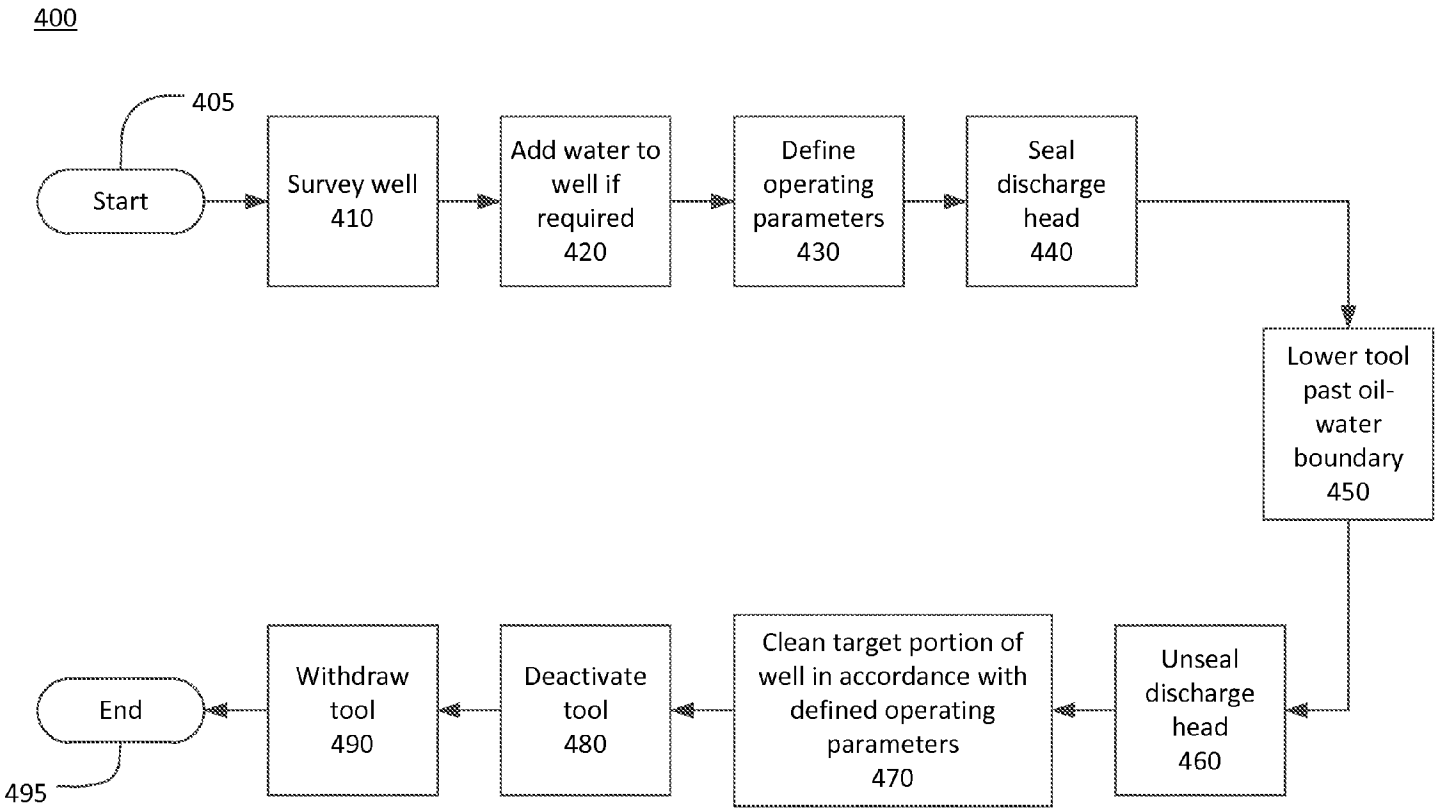
FIG. 4 is a flow chart of a process for cleaning a well bore.

Referring now to FIG. 4, a process 400 for cleaning an oil well may start at 405 when a well cleaning system, such as the well cleaning system 100, is made available at the site of the well. The process 400 may conclude at 495 after the well has been cleaned. The process 400 is a process for cleaning at least one target portion of an oil well of flow-restricting deposits using a cleaning tool, such as the cleaning tool 130, that discharges stored electric energy to generate shock waves to remove the deposits.

To avoid degradation, a cleaning tool, such as the cleaning tool 130, may be inhibited from generating electrical discharges when the environment about the tool is primarily oil, or when a discharge head is contaminated with oil. Thus it may be necessary to determine a depth of an oil-water boundary within the well before cleaning the well. At 410 a survey of the well may be conducted by lowering one or more survey tools or instruments into the well. The survey at 410 may be performed by an operator of the well, by the party who will clean the well, or by a third-party oil field services contractor. The location of the oil-water boundary may be determined, for example, by lowering an appropriate tool into the well and measuring one or more of electrical resistivity or conductivity, opacity, viscosity, dielectric constant, inductance, capacitance, or some other parameter indicative of the fluid content of the well as a function of depth within the well.

Surveying the well at 410 may also include determining the temperature and the conductivity or salinity of the fluids in the well as a function of depth, or a least at the one or more target portions of the well to be cleaned. Additionally, surveying the well at 410 may include a caliper measurement or other casing assessment survey or video inspection of the well to locate any severely corroded or otherwise compromised portions of the casing. To avoid further degradation of compromised portions of the casing, such portions may not be subjected to the cleaning process. A video inspection at 410 may also determine the nature and extent of the deposits to be removed by the well cleaning process.

If the results of the survey at 410 indicate that the oil-water boundary is at or below a target portion of the well to be cleaned, water may be added to the well (and oil necessarily extracted from the top of the well) at 420 to raise the oil-water boundary above all of the at least one target portion to be cleaned. Adding water to the well at 420 or continuously during the cleaning process may be an effective method to cool the fluids in the well if necessary to allow operation of the cleaning tool.

At 430, operating parameters for the cleaning tool may be determined. Operating parameters may be based, at least in part, on results of the survey performed at 410. The operating parameters may include a minimum operational depth to which the cleaning tool must be lowered before stored energy can be discharged without incurring degradation. The minimum operational depth may be based on the depth of the oil-water boundary from 410 and the amount of water, if any, added to the well at 420. The operating parameters may include a discharge repetition rate and/or a maximum duration of operation based on the temperature of the fluid in the well at each target portion to be cleaned. The operating parameters may include a speed at which the cleaning tool is lowered through each target portion of the casing while repeatedly discharging to generate shock waves. The operating parameters determined at 430 may include an energy per discharge level based on an inside diameter of each target portion of the well casing to be cleaned and/or the nature and extent of the deposits seen during video inspection of the well at 410.

The operating parameters determined at 430 may include a spacing of the electrodes in the discharge head based on the electrical conductivity or salinity of the fluids in the well. The spacing determined for the electrodes may be generally inverse to the conductivity of the fluids in the well. The electrodes may be closely spaced if the fluids in the well have low conductivity and the electrodes may be spaced further apart if the fluids are highly conductive.

As previously discussed, deterioration of the discharge head may occur if the cleaning tool is discharged when oil is present within the tool discharge head. To avoid this deterioration, all or a portion of the discharge head may be sealed at 440 to prevent fouling the discharge head with oil as the tool is lowered through the oil layer above the oil-water boundary in the well. Sealing the discharge head at 440 may include positioning a retractable cover configured to seal the discharge head, or at least the surface of the insulator 244 that isolates electrode 242 from the structure of the cleaning tool 130, from the oil.

Sealing the discharge head at 440 may include installing a consumable cover configured to seal the discharge head, or at least the insulator surface within the discharge head, from the oil. For example, the seal installed at 440 may be a preformed cover that is sealed over all or portions of the discharge head using adhesive tape before the tool is lowered into a well. The consumable cover may be filled with water or another fluid to provide a medium in which an initial discharge may occur.

Sealing the discharge head at 440 may include applying a consumable coating over portions of the discharge head, or at least the insulator surface within the discharge head, before the tool is lowered into a well. The coating may be a material impervious to oil and soluble in water, such that the coating dissolves when the cleaning tool reaches the water-filled portion of the well. The coating material may be, for example, a liquid soap or liquid detergent, which may also serve to emulsify any residual oil on the discharge head.

At 450, the cleaning tool may be lowered through the oil-water boundary into a primarily water-filled portion of the well. After the cleaning tool passes below the oil-water boundary, the discharge head may be unsealed at 460 to allow operation of the cleaning tool in the water-filled portion of the well. When the discharge head is sealed by a retractable cover, at 460 the cover may be retracted, for example using a motor, a solenoid, a spring, or some other mechanism. When the discharge head is sealed by a consumable cover, the consumable cover may be destroyed or otherwise dislodged from the tool at 460 by one or more shock waves resulting from discharging the cleaning tool. When the discharge head was sealed using a consumable coating, at 460, the coating may dissolve in the water that fills the well below the oil-water boundary.

After the discharge head is unsealed at 460, the target portion or portions of the well may be cleaned at 470. Cleaning may be performed by lowering or raising the tool through each target portion while repeatedly discharging stored energy to generate shock waves. Each target portion may be cleaned by a single upward or downward pass of the cleaning tool. Each target portion may be cleaned by multiple upward and/or downward passes of the cleaning tool. During cleaning, the cleaning tool may be operated in accordance with the operating parameters defined at 430.

After the cleaning has been completed at 470, the cleaning tool may be deactivated at 480 to ensure that the tool does not discharge stored energy while it is being withdrawn from the casing at 490. For example, the cleaning tool may be deactivated at 480 by a command sent from a control subsystem on the surface to a controller within the tool. The cleaning tool may be deactivated at 480 by discontinuing the delivery of power from the surface to the tool. The process 400 may end at 495 after the tool has been withdrawn from the well.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

As used herein, "plurality" means two or more. As used herein, a "set" of items may include one or more of such items. As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims. Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. As used herein, "and/or" means that the listed items are alternatives, but the alternatives also include any combination of the listed items.

It is claimed:

1. A method for cleaning a casing of an oil well, comprising:

defining operational parameters for a cleaning tool based, at least in part, on results of a survey of the well;

lowering the cleaning tool into the casing, the cleaning tool including a discharge head to generate electrical discharges between a pair of electrodes, the electrical discharges causing shock waves to remove deposits from the casing;

generating shock waves with the cleaning tool in accordance with the defined operational parameters to clean a first target portion of the casing; and withdrawing the cleaning tool from the casing, wherein the results of the survey of the well include a determination of a temperature within the predetermined target portion of the casing, and defining cleaning parameters including defining at least one of a maximum duration of operation and a maximum discharge repetition rate for the cleaning tool based on the temperature.

2. The method of claim 1, wherein the results of the survey of the well include a determination of a conductivity of fluids in the target portion of the casing, and defining cleaning parameters includes selecting a spacing for the pair of electrodes based, in part, on the conductivity of the fluids in the target portion of the casing.

3. A method for cleaning a casing of an oil well, comprising:

defining operational parameters for a cleaning tool based, at least in part, on results of a survey of the well;

lowering the cleaning tool into the casing, the cleaning tool including a discharge head to generate electrical discharges between a pair of electrodes, the electrical discharges causing shock waves to remove deposits from the casing;

generating shock waves with the cleaning tool in accordance with the defined operational parameters to clean a first target portion of the casing; and withdrawing the cleaning tool from the casing, wherein defining cleaning parameters includes selecting an energy of each electrical discharge based, in part, on a diameter of the target portion of the casing.

4. The method of claim 3, wherein the results of the survey of the well include a determination of a conductivity of fluids in the target portion of the casing, and defining cleaning parameters includes selecting a spacing for the pair of electrodes based, in part, on the conductivity of the fluids in the target portion of the casing.

5. A method for cleaning a casing of an oil well, comprising:

defining operational parameters for a cleaning tool based, at least in part, on results of a survey of the well;

lowering the cleaning tool into the casing, the cleaning tool including a discharge head to generate electrical discharges between a pair of electrodes, the electrical discharges causing shock waves to remove deposits from the casing;

generating shock waves with the cleaning tool in accordance with the defined operational parameters to clean a first target portion of the casing; and withdrawing the cleaning tool from the casing, wherein the results of the survey of the well include a video inspection of the target portion of the casing, and defining cleaning parameters includes selecting an energy of the electrical discharges based, in part, on a relative amount of deposits visible in the video inspection of the target portion of the casing.

6. The method of claim 5, wherein the results of the survey of the well include a determination of a conductivity of fluids in the target portion of the casing, and defining cleaning parameters includes selecting a spacing for the pair of electrodes based, in part, on the conductivity of the fluids in the target portion of the casing.

7. A method for cleaning a casing of an oil well, comprising:

defining operational parameters for a cleaning tool based, at least in part, on results of a survey of the well;

lowering the cleaning tool into the casing, the cleaning tool including a discharge head to generate electrical discharges between a pair of electrodes, the electrical discharges causing shock waves to remove deposits from the casing;

generating shock waves with the cleaning tool in accordance with the defined operational parameters to clean a first target portion of the casing; and withdrawing the cleaning tool from the casing, wherein the results of the survey of the well include identification of one or more compromised portions of the casing, and defining cleaning parameters includes inhibiting the cleaning tool from generating electrical discharges in the one or more compromised portions of the casing.

8. The method of claim 7, wherein the results of the survey of the well include a determination of a conductivity of fluids in the target portion of the casing, and defining cleaning parameters includes selecting a spacing for the pair of electrodes based, in part, on the conductivity of the fluids in the target portion of the casing.

9. A method for cleaning a casing of an oil well, comprising:

defining operational parameters for a cleaning tool based, at least in part, on results of a survey of the well, the results of the survey of the well including a determination of a depth of an oil-water boundary between a primarily oil-filled upper region of the casing and a primarily water-filled lower region of the casing;

lowering the cleaning tool into the casing, the cleaning tool including a discharge head to generate electrical discharges between a pair of electrodes, the electrical discharges causing shock waves to remove deposits from the casing;

before lowering the cleaning tool into the casing, sealing all or a portion of the discharge head;

unsealing the discharge head after the cleaning tool is lowered below the oil-water boundary;

after unsealing the discharge head, generating shock waves with the cleaning tool in accordance with the defined operational parameters to clean a target portion of the casing; and withdrawing the cleaning tool from the casing.

10. The method of claim 9, wherein sealing all or portions of the discharge head comprises closing a retractable cover, and unsealing the discharge head comprises retracting the retractable cover.

11. The method of claim 9, wherein sealing all or a portion of the discharge head comprises installing a consumable cover, and unsealing the discharge head comprises removing the consumable cover with shock waves caused by one or more electrical discharges.

12. The method of claim 9, wherein sealing all or a portion of the discharge head comprises applying an oil-resistant water-soluble coating, and unsealing the discharge head comprises dissolving the oil-resistant water-soluble coating in water present in the water-filled lower portion of the casing.

13. The method of claim 9, wherein sealing all or a portion of the discharge head comprises sealing at least one insulating surface within the discharge head.

14. The method of claim 9, further comprising inhibiting the cleaning tool from generating the electrical discharges while the cleaning tool is above the oil-water boundary.

15. A method for cleaning a casing of an oil well, comprising:

defining operational parameters for a cleaning tool based, at least in part, on results of a survey of the well, the results of the survey of the well including a determination of a depth of an oil-water boundary between a primarily oil-filled upper region of the casing and a primarily water-filled lower region of the casing;

when the survey of the well determines that the oil-water boundary is not above a target portion of the casing, adding water to the well to raise the oil-water boundary above the target portion of the casing;

lowering the cleaning tool into the casing, the cleaning tool including a discharge head to generate electrical discharges between a pair of electrodes, the electrical discharges causing shock waves to remove deposits from the casing;

generating shock waves with the cleaning tool in accordance with the defined operational parameters to clean the target portion of the casing; and withdrawing the cleaning tool from the casing.

16. The method of claim 15, further comprising inhibiting the cleaning tool from generating the electrical discharges while the cleaning tool is above the oil-water boundary.

* * * * *